US011199355B2

(12) United States Patent
Li et al.

(10) Patent No.: US 11,199,355 B2
(45) Date of Patent: Dec. 14, 2021

(54) DEVICE FOR SELF-ADAPTIVE REGULATION OF AIR VOLUME AND REFRIGERATOR HAVING SAME

(71) Applicants: HEFEI HUALING CO., LTD., Anhui (CN); HEFEI MIDEA REFRIGERATOR CO., LTD., Anhui (CN); MIDEA GROUP CO., LTD., Guangdong (CN)

(72) Inventors: Jun Li, Anhui (CN); Xiuhua Geng, Anhui (CN); Haichao Zhang, Anhui (CN)

(73) Assignees: HEFEI HUALING CO., LTD., Hefei (CN); HEFEI MIDEA REFRIGERATOR CO., LTD., Hefei (CN); MIDEA GROUP CO., LTD., Foshan (CN)

( * ) Notice: Subject to any disclaimer, the term of this patent is extended or adjusted under 35 U.S.C. 154(b) by 49 days.

(21) Appl. No.: 16/335,934

(22) PCT Filed: Mar. 31, 2017

(86) PCT No.: PCT/CN2017/079057
§ 371 (c)(1),
(2) Date: Mar. 22, 2019

(87) PCT Pub. No.: WO2018/054029
PCT Pub. Date: Mar. 29, 2018

(65) Prior Publication Data

US 2019/0310007 A1 Oct. 10, 2019

(30) Foreign Application Priority Data

Sep. 23, 2016 (CN) ..... 201610848145.6

(51) Int. Cl.
*F25D 11/02* (2006.01)
*F25D 21/14* (2006.01)
(Continued)

(52) U.S. Cl.
CPC ..... *F25D 11/02* (2013.01); *F25D 17/065* (2013.01); *F25D 21/14* (2013.01); *F25D 23/065* (2013.01);
(Continued)

(58) Field of Classification Search
CPC ..... F25D 11/02; F25D 17/065; F25D 17/045; F25D 17/062; F25D 17/08; F25D 21/14;
(Continued)

(56) References Cited

U.S. PATENT DOCUMENTS 3,065,553 A * 11/1962 Olin ..... A23B 4/00 34/191
7,468,495 B2 * 12/2008 Carbone ..... F24C 15/325 126/21 A

FOREIGN PATENT DOCUMENTS

CN 201532067 U 7/2010
CN 104101159 A 10/2014
(Continued)

OTHER PUBLICATIONS

Machine translation of WO2016086429 (Year: 2016).*
(Continued)

*Primary Examiner* — Joseph F Trpisovsky
(74) *Attorney, Agent, or Firm* — Seed IP Law Group LLP

(57) ABSTRACT

Provided are a device (100) for self-adaptive regulation of air volume and a refrigerator (200) having the same. The regulating device (100) comprises: a drainage and air guide cavity (1), arranged on the back of a freezing chamber (201) of a refrigerator, the drainage and air guide cavity (1) comprising a funnel-shaped air collecting cavity (11) and a
(Continued)

conical air outlet cavity (12) connected to the funnel-shaped air collecting cavity (11), an outlet of the conical air outlet cavity (12) facing a refrigerating chamber; a drainage tongue (2), provided in the conical air outlet cavity (12) so as to create a first outlet duct (122) and a second outlet duct (123) within the conical air outlet cavity (12), an inlet (20*a*) of the first outlet duct (122) being located on an extension line of a left side wall (113) of the funnel-shaped air collecting cavity (11) and an inlet (21*a*) of the second outlet duct (123) being located on an extension line of a right side wall (112) of the funnel-shaped air collecting cavity (11); and a fan (3) arranged inside of the funnel-shaped air collecting cavity (11). By rotating the fan (3), cold air is conveyed through the first outlet duct (122) and the second outlet duct (123) and into a refrigerating chamber (202) under the guide of the left side wall (113) or right side wall (112) of the funnel-shaped air collecting cavity (11).

7 Claims, 1 Drawing Sheet

(51) Int. Cl.

| | |
|---|---|
| ***F25D 17/06*** | (2006.01) |
| ***F25D 23/06*** | (2006.01) |
| *F25D 17/04* | (2006.01) |
| *F25D 17/08* | (2006.01) |

(52) U.S. Cl.
CPC ..... *F25D 17/045* (2013.01); *F25D 17/062* (2013.01); *F25D 17/08* (2013.01); *F25D 2317/063* (2013.01); *F25D 2317/0666* (2013.01); *F25D 2317/0672* (2013.01); *F25D 2317/0684* (2013.01)

(58) Field of Classification Search
CPC .... F25D 23/065; F25D 23/068; F25D 23/069; F25D 2317/063; F25D 2317/06; F25D 2317/0666; F25D 2317/067; F25D 2317/0671; F25D 2317/0672; F25D 2317/0684; F25D 2323/00283
See application file for complete search history.

(56) References Cited

FOREIGN PATENT DOCUMENTS

| | | | | |
|---|---|---|---|---|
| CN | 104457096 | A | 3/2015 | |
| CN | 105758093 | A | 7/2016 | |
| CN | 106322887 | A | 1/2017 | |
| JP | 2002-107041 | A | 4/2002 | |
| KR | 2001-0068689 | A | 7/2001 | |
| WO | WO-2016086429 | A1 * | 6/2016 | ..... F25D 21/14 |

OTHER PUBLICATIONS

International Search Report dated Jul. 4, 2017, for International Application No. PCT/CN2017/079057, 7 pages. (with English translation).

* cited by examiner

DEVICE FOR SELF-ADAPTIVE REGULATION OF AIR VOLUME AND REFRIGERATOR HAVING SAME

CROSS-REFERENCE

The present application claims priority to Chinese Patent Application No. 201610848145.6, filed on Sep. 23, 2016, entitled "Device for Self-adaptive Regulation of Air Volume and Refrigerator Having Same", the disclosure of which is incorporated herein by reference in its entirety.

TECHNICAL FIELD

The present application relates to the technical field of air volume regulation of household refrigerators, and specifically to a device for self-adaptive regulation of air volume and a refrigerator having the same.

BACKGROUND

At present, as the types of refrigerators are becoming more and more on the market, people are demanding higher on the performance of refrigerators. For example, the refrigeration performance of refrigerators is being demanded higher and higher by people. Refrigerating-type or freezing-type refrigerators generally use manual dampers or electric dampers to control the air volume supplied to the refrigerating chamber from the freezing chamber during refrigerating.

However, the manual damper may have the disadvantages that it is inconvenient to regulate manually, and cannot supply air correspondingly according to the temperature of the refrigerating chamber in real time, resulting in inflexible and untimely temperature regulation of the refrigerator. In addition, the electric damper has a high cost and a complicated assembly structure, and is prone to fail, which affects the performance of the refrigerator.

SUMMARY

(I) Technical Problem to be Solved

The present application aims to provide a device for self-adaptive regulation of air volume and a refrigerator having the same, so as to solve the problem that the existing air volume regulating device cannot supply air correspondingly according to the temperature of the refrigerating chamber in real time.

(II) Technical Solutions

In order to solve the technical problem above, a device for self-adaptive regulation of air volume is provided according to the first aspect of the present application. The device includes: an air draft and guide cavity provided on a back of a freezing chamber of a refrigerator, the air draft and guide cavity including a funnel-shaped air collecting cavity and a conical air outlet cavity connected to the funnel-shaped air collecting cavity, wherein an outlet of the conical air outlet cavity faces a refrigerating chamber; a division tongue provided in the conical air outlet cavity so as to create a first outlet duct and a second outlet duct within the conical air outlet cavity, wherein an inlet of the first outlet duct is located on an extension line of a left side wall of the funnel-shaped air collecting cavity, and an inlet of the second outlet duct is located on an extension line of a right side wall of the funnel-shaped air collecting cavity; and a fan provided inside the funnel-shaped air collecting cavity; wherein by means of rotation of the fan, cold air is conveyed through the first outlet duct and/or the second outlet duct and into the refrigerating chamber under guidance of the left side wall or the right side wall of the funnel-shaped air collecting cavity.

In an embodiment, a portion of the division tongue adjacent to the funnel-shaped air collecting cavity is configured with a first side wall and a second side wall, wherein the first side wall is parallel to the left side wall of the funnel-shaped air collecting cavity, and the second side wall is parallel to the right side wall of the funnel-shaped air collecting cavity.

In an embodiment, the division tongue is provided on a front or rear side wall of an upper portion of the conical air outlet cavity.

In an embodiment, the portion of the division tongue adjacent to the funnel-shaped air collecting cavity is configured as a structure in which a tip end faces upstream, when the fan rotates in a counterclockwise direction, the first side wall is parallel to a right side wall of an upper portion of the conical air outlet cavity so as to form the first outlet duct; the second side wall is parallel to a left side wall of the upper portion of the conical air outlet cavity so as to form the second outlet duct.

In an embodiment, the portion of the division tongue adjacent to the funnel-shaped air collecting cavity is configured as a structure in which a tip end faces upstream, when the fan rotates in a clockwise direction, the second side wall is parallel to a left side wall of an upper portion of the conical air outlet cavity so as to form the first outlet duct; the first side wall is parallel to a right side wall of the upper portion of the conical air outlet cavity so as to form the second outlet duct.

In an embodiment, a lateral width of a portion of the division tongue away from the funnel-shaped air collecting cavity successively decreases from top to bottom, wherein an outer surface of the portion of the division tongue away from the funnel-shaped air collecting cavity is configured as an arc-transition surface.

In an embodiment, an outlet of the funnel-shaped air collecting cavity is connected to the inlet of the first outlet duct and the inlet of the second outlet duct respectively, an outlet of the first outlet duct and an outlet of the second outlet duct are connected to the outlet of the conical air outlet cavity.

According to the second aspect of the present application, a refrigerator is further provided, including the device for self-adaptive regulation of air volume above.

(III) Advantageous Effects

Compared with the prior art, the regulating device of the present application has the following advantages:

In the regulating device of the present application, by providing the division tongue, the conical air outlet cavity is configured with the first outlet duct and the second outlet duct. When the current temperature inside the refrigerating chamber is low, which indicates that the air volume of the cold air needed by the refrigerating chamber is small, the fan can operate at a relatively low rate, the air volume of most of the cold air blown out by the fan is conveyed into the refrigerating chamber via the first outlet duct under the guidance of the right side wall or the left side wall of the funnel-shaped air collecting cavity, and a smaller portion of the air volume of the cold air is further reduced under the reflection of the wall surface of the division tongue, and is conveyed into the refrigerating chamber via the second outlet duct. On the contrary, when the temperature inside the refrigerating chamber is high and needs to be reduced rapidly, which indicates that the air volume of the cold air needed by the refrigerating chamber is large, the fan should operate at a relatively high rate. As the fan continuously operate at a high rate such that the air pressure inside the funnel-shaped air collecting cavity increases continuously, the air volume of the cold air via the first outlet duct and the second outlet duct increases as well. In addition, the air volume of the cold air conveyed into the refrigerating chamber increases, so that the temperature inside the refrigerating chamber decreases rapidly, thereby significantly improving the cooling effect on the refrigerating chamber.

Therefore, by providing the division tongue, the regulating device of the present application can convey the corresponding air volume of the cold air according to the temperature inside the refrigerating chamber in real time. In addition, the regulating device of the present application improves the regulating flexibility and convenience of the temperature inside the refrigerating chamber, and ensures the cooling effect on the refrigerating chamber.

In addition, dampers are eliminated in the regulating device of the present application, which, compared with the prior art that electric dampers are required to be mounted at the outlet of the air duct, not only saves the economical cost, but also greatly reduces the difficulty of assembly, and avoids the disadvantage of affecting the performance of the refrigerator due to malfunctions.

Figure 1:
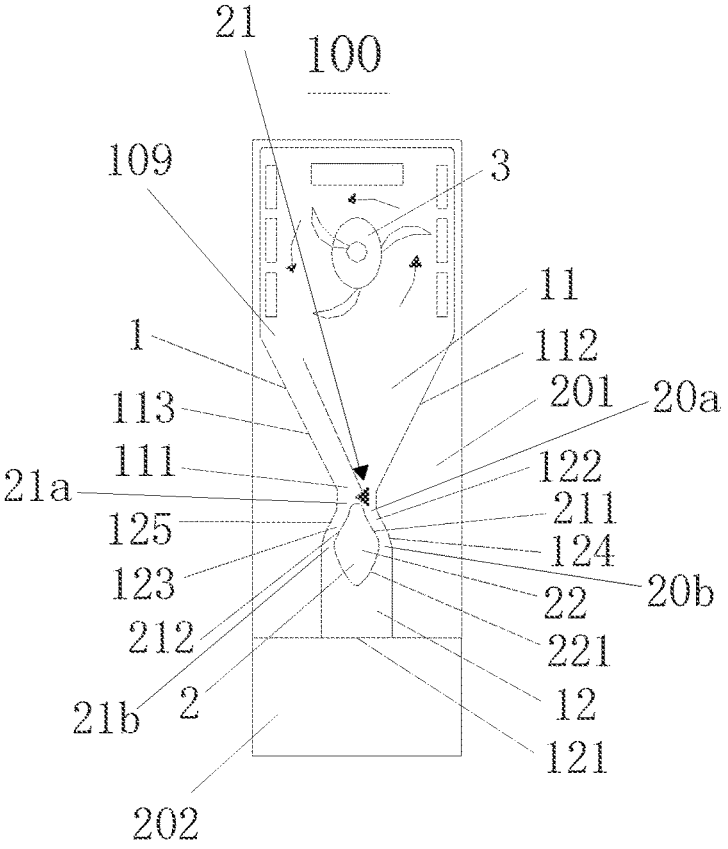
FIG. 1 is an overall structural diagram of the device for self-adaptive regulation of air volume according to an embodiment of the present application.

In the drawings, 100: regulating device; 200: refrigerator; 1: air draft and guide cavity; 11: funnel-shaped air collecting cavity; 12: conical air outlet cavity; 111: outlet of the funnel-shaped air collecting cavity; 121: outlet of the conical air outlet cavity; 122: first outlet duct; 123: second outlet duct; 124: right side wall; 125: left side wall; 126: rear side wall; 20*a*: inlet; 20*b*: outlet; 21*a*: inlet; 21*b*: outlet; 2: division tongue; 21: portion of the division tongue adjacent to the funnel-shaped air collecting cavity; 22: portion of the division tongue away from the funnel-shaped air collecting cavity; 221: outer surface of lower portion of the division tongue; 211: right side wall; 212: left side wall; 3: fan; 201: freezing chamber; 202: refrigerating chamber.

DETAILED DESCRIPTION

The specific description of the present application will be further described in detail hereinafter with reference to the accompanying drawings and embodiments. The following examples are used to illustrate the present application, but are not intended to limit the scope thereof.

EMBODIMENT 1: In the embodiments of the present application, a regulating device 100 is provided according to the first aspect of the present application. The regulating device 100 includes an air draft and guide cavity 1, a division tongue 2 and a fan 3.

The air draft and guide cavity 1 is provided on a back of a freezing chamber 201 of a refrigerator 200. It should be noted that, the air draft and guide cavity 1 shown in the drawings is when it is mounted normally, that is, the air draft and guide cavity 1 is mounted longitudinally along the back of the freezing chamber 201 of the refrigerator 200.

The air draft and guide cavity 1 includes a funnel-shaped air collecting cavity 11 and a conical air outlet cavity 12 connected to the funnel-shaped air collecting cavity 11, wherein an outlet of the conical air outlet cavity 12 faces a refrigerating chamber 202.

The division tongue 2 is provided in the conical air outlet cavity 12 so as to create a first outlet duct 122 and a second outlet duct 123 connected to the first outlet duct 122 within the conical air outlet cavity 12, wherein an inlet 20*a* of the first outlet duct 122 is located on an extension line of a left side wall 113 of the funnel-shaped air collecting cavity 11, and an inlet 21*a* of the second outlet duct 123 is located on an extension line of a right side wall 112 of the funnel-shaped air collecting cavity 11.

The fan 3 is arranged inside the funnel-shaped air collecting cavity 11. By means of rotation of the fan 3, cold air is conveyed through the first outlet duct 122 and/or the second outlet duct 123 and into the refrigerating chamber 202 under guidance of the left side wall 113 or the right side wall 112 of the funnel-shaped air collecting cavity 11. Specifically, since the air draft and guide cavity 1 is configured as a funnel-shaped air collecting cavity 11 and a conical air outlet cavity 12 connected to the funnel-shaped air collecting cavity 11, an inner diameter of the portion where the funnel-shaped air collecting cavity 11 and the conical air outlet cavity 12 are connected is small, so that the air pressure of the cold air conveyed to the refrigerating chamber 202 from the freezing chamber 201 is increased.

In addition, since the division tongue 2 is provided inside the conical air outlet cavity 12, the conical air outlet cavity 12 is configured with the first outlet duct 122 and the second outlet duct 123. It is to be appreciated that, when the current temperature inside the refrigerating chamber 202 is low, it indicates that the air volume of the cold air needed by the refrigerating chamber 202 is small. Therefore, the fan 3 can operate at a relatively low rate. At this time, the air volume of most of the cold air blown out by the fan 3 is conveyed into the refrigerating chamber 202 via the first outlet duct 122 under the guidance of the right side wall 112 or the left side wall 113 of the funnel-shaped air collecting cavity 11, and a smaller portion of the air volume of the cold air is further reduced under the reflection of the wall surface of the division tongue 2, and is conveyed into the refrigerating chamber 202 via the second outlet duct 123.

It is to be appreciated that, in the case that the fan 3 runs for a short time, after the cold air blown out by the fan 3 encounters the division tongue 2, a portion of the air volume of the cold air is wore and consumed under the reflection of the wall surface of the division tongue, and the other portion of the air volume of the cold air is conveyed into the refrigerating chamber 202 via the first outlet duct 122. Therefore, by providing the division tongue 2, the air volume of the cold air is divided and reasonably distributed.

On the contrary, when the temperature inside the refrigerating chamber 202 is high and needs to be reduced rapidly, which indicates that the air volume of the cold air needed by the refrigerating chamber 202 is large, and the fan 3 should operate at a relatively high rate. As the fan 3 continuously operates at a high rate, the air pressure inside the funnel-shaped air collecting cavity 11 increases continuously, therefore the air volume of the cold air via the first outlet duct 122 and the second outlet duct 123 increases as well. In addition, the air volume of the cold air conveyed into the refrigerating chamber 202 increases, so that the temperature inside the refrigerating chamber 202 decreases rapidly, thereby significantly improving the cooling effect on the refrigerating chamber 202.

Therefore, by providing the division tongue 2, the regulating device 100 of the present application can convey the corresponding air volume of the cold air according to the temperature inside the refrigerating chamber 202 in real time. In addition, the regulating device 100 of the present application improves the regulating flexibility and convenience of the temperature inside the refrigerating chamber 202, and ensures the cooling effect on the refrigerating chamber 202.

Further, dampers are eliminated in the regulating device 100 of the present application, which, compared with the prior art that electric dampers are required to be mounted at the outlet of the air duct, not only saves the economical cost, but also greatly reduces the difficulty of assembly, and avoids the disadvantage of affecting the performance of the refrigerator 200 due to malfunctions.

As shown in FIG. 1, in an embodiment, a portion of the division tongue 2 adjacent to the funnel-shaped air collecting cavity 11 is configured with a first side wall 211 and a second side wall 212.

In the embodiment, the first side wall 211 is parallel to the left side wall 113 of the funnel-shaped air collecting cavity 11, and the second side wall 212 is parallel to the right side wall 112 of the funnel-shaped air collecting cavity 11. In this way, when the fan 3 rotates in a counterclockwise direction, the left side wall 113 of the funnel-shaped air collecting cavity 11 mainly serves to guide the air into the first outlet duct 122; when the fan 3 rotates in a clockwise direction, the right side wall 112 of the funnel-shaped air collecting cavity 11 mainly serves to guide the air into the second outlet duct 123. In this description, a "primary outlet duct" is used to refer to an outlet duct 122, 123 which the air is guided into. A "secondary outlet duct" is used to refer to an outlet duct 122, 123 which the air is not guided into but may pass through as a secondary route.

As shown in FIG. 1, the funnel-shaped air collecting cavity 11 is configured as a funnel structure, and the conical air outlet cavity 12 is configured as a conical structure. It is to be appreciated that, the funnel structure is a structure in which the lateral width decreases gradually. Therefore, the air pressure of the cold air will increase gradually when the cold air blown out by the fan 3 is flowing from top to bottom along the interior of the funnel-shaped air collecting cavity 11, hence the cold air can be rapidly conveyed into the refrigerating chamber 202 so that the refrigerating chamber 202 can cool down quickly.

The conical air outlet cavity 12 is configured as a conical structure so as to increase the cooling capacity of the cold air conveyed into the refrigerating chamber 202, so that the temperature inside the refrigerating chamber 202 can be reduced rapidly.

As shown in FIG. 1, in an embodiment, the division tongue 2 is provide on a front or rear side wall 126 of an upper half portion of the conical air outlet cavity 12. Specifically, the division tongue 2 may be fastened to the front or rear side wall 126 of the upper half portion of the conical air outlet cavity 12 by fasteners such as screws or rivets, etc. Therefore, by using the detachable connection, the division tongue 2 is facilitated to be mounted and dismounted. In addition, the division tongue 2 is provided on the upper half portion of the conical air outlet cavity 12 so as to facilitate the drainage of the conical air outlet cavity 12.

In an embodiment, a portion 21 of the division tongue 2 adjacent to the funnel-shaped air collecting cavity 11 is configured as a structure in which a tip end faces upstream, when the fan 3 rotates in a counterclockwise direction, the first side wall 211 of the portion 21 of the division tongue 2 adjacent to the funnel-shaped air collecting cavity 21 is parallel to a right side wall 124 of an upper portion of the conical air outlet cavity 12 so as to form the first outlet duct 122. It is to be appreciated that, when the fan 3 rotates in a counterclockwise direction, the first outlet duct 122 is the main air outlet duct, and the second outlet duct 123 is the side air outlet duct.

The second side wall 212 of the portion 21 of the division tongue 2 adjacent to the funnel-shaped air collecting cavity 21 is parallel to a left side wall 125 of the upper portion of the conical air outlet cavity 12 so as to form the second outlet duct 123. Therefore, the arrangement of the division tongue 2 serves to divide and distribute the air volume of the cold air conveyed from the freezing chamber 201 into the refrigerating chamber 202. In addition, the regulation of the cooling capacity of the cold air conveyed into the refrigerating chamber 202 is achieved by conveying different cooling capacities of the cold air to the first outlet duct 122 and the second outlet duct 123, thus the regulation of the temperature inside the refrigerating chamber 202 is achieved.

In addition, the portion 21 of the division tongue 2 adjacent to the funnel-shaped air collecting cavity 11 is configured as the structure in which a tip end faces upstream so that the flow direction of the cold air is guided, which facilitates the dividing of the air volume of the cold air. It should be noted that, "upstream" refers to the top of the drawings.

In another embodiment, when the fan 3 rotates in a clockwise direction, the second side wall 212 of the portion 21 of the division tongue 2 adjacent to the funnel-shaped air collecting cavity 21 is parallel to the left side wall 125 of the upper portion of the conical air outlet cavity 12 so as to form the first outlet duct 122 as the primary outlet duct.

The first side wall 211 of the portion 21 of the division tongue 2 adjacent to the funnel-shaped air collecting cavity 21 is parallel to the right side wall 124 of the upper portion of the conical air outlet cavity 12 so as to form the second outlet duct 123. It is to be appreciated that, during the operation of the fan 3, when the fan 3 rotates in a counterclockwise direction, the left side wall 113 of the funnel-shaped air collecting cavity 11 serves to guide the flow direction of the cold air, so that most of the cold air is conveyed into the first outlet duct 122, as the primary outlet duct, and the smaller portion of the cold air is conveyed into the second outlet duct 123, as the secondary outlet duct. On the contrary, when the fan 3 rotates in a clockwise direction, the right side wall 112 of the funnel-shaped air collecting cavity 11 serves to guide the flow direction of the cold air, so that most of the cold air is conveyed into the second outlet duct 123, as the primary outlet duct, and the smaller portion of the cold air is conveyed into the first outlet duct 122, as the secondary outlet duct.

In order to further optimize the division tongue 2 in the solutions above, a lateral width of a portion 22 of the division tongue 2 away from the funnel-shaped air collecting cavity 11 successively decreases from top to bottom on the basis of the technical solutions above, wherein an outer surface 221 of the lower portion 22 of the division tongue 2 is configured as an arc-transition surface. Specifically, by configuring the lateral width of the lower portion 22 of the division tongue 2 to successively decrease from top to bottom, the diameter of the lower portion of the conical air outlet cavity 12 is increased gradually, therefore the air volume of the cold air conveyed into the refrigerating chamber 202 is guaranteed.

In addition, by configuring the outer surface 221 of the lower portion 22 of the division tongue 2 as an arc-transition surface, when the cold air encounters the outer surface 221 of the lower portion 22 of the division tongue 2, the loss of the air volume of the cold air can be reduced significantly, therefore the cooling capacity of the cold air conveyed into the refrigerating chamber 202 is ensured.

As shown in FIG. 1, in an embodiment, an inlet 109 of the funnel-shaped air collecting cavity 11 is below the fan 3 and at a top end of the funnel-shape air collecting cavity 11 based on the orientation as shown FIG. 1. As shown in FIG. 1, in an embodiment, an outlet 111 of the funnel-shaped air collecting cavity 11 is connected to the inlet 20*a* of the first outlet duct 122 and the inlet 21*a* of the second outlet duct 123 respectively; an outlet 20*b* of the first outlet duct 122 and an outlet 21*b* of the second outlet duct 123 are connected to the outlet 121 of the conical air outlet cavity 12. In this way, an internal connection of the air draft and guide cavity 1 is achieved.

Figure 2:
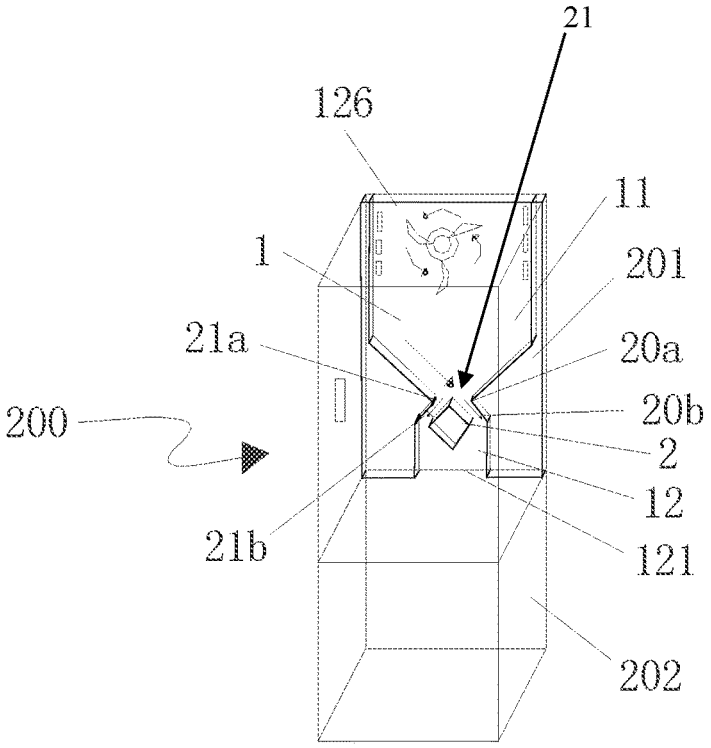
FIG. 2 is an overall structural diagram of the refrigerator according to an embodiment of the present application.

As shown in FIG. 2, a refrigerator 200 is provided according to the second aspect of the present application. The refrigerator 200 has the device 100 for self-adaptive regulation of air volume above.

In summary, in the regulating device 100 of the present application, by providing the division tongue 2, the conical air outlet cavity 12 is configured with the first outlet duct 122 and the second outlet duct 123. When the current temperature inside the refrigerating chamber 202 is low, which indicates that the air volume of the cold air needed by the refrigerating chamber 202 is small, the fan 3 can operate at a relatively low rate, the air volume of most of the cold air blown out by the fan 3 is conveyed into the refrigerating chamber 202 via the first outlet duct 122 under the guidance of the right side wall 112 or the left side wall 113 of the funnel-shaped air collecting cavity 11, and a smaller portion of the air volume of the cold air is further reduced under the reflection of the wall surface of the division tongue 2, and is conveyed into the refrigerating chamber 202 via the second outlet duct 123. On the contrary, when the temperature inside the refrigerating chamber 202 is high and needs to be reduced rapidly, which indicates that the air volume of the cold air needed by the refrigerating chamber 202 is large, the fan 3 should operate at a relatively high rate. As the fan 3 continuously operate at a high rate, the air pressure inside the funnel-shaped air collecting cavity 11 increases continuously, the air volume of the cold air via the first outlet duct 122 and the second outlet duct 123 increases as well. In addition, the air volume of the cold air conveyed into the refrigerating chamber 202 increases, so that the temperature inside the refrigerating chamber 202 decreases rapidly, thereby significantly improving the cooling effect on the refrigerating chamber 202.

Therefore, by providing the division tongue 2, the regulating device 100 of the present application can convey the corresponding air volume of the cold air according to the temperature inside the refrigerating chamber 202 in real time. In addition, the regulating device 100 of the present application improves the regulating flexibility and convenience of the temperature inside the refrigerating chamber 202, and ensures the cooling effect on the refrigerating chamber 202.

In addition, dampers are eliminated in the regulating device 100 of the present application, which, compared with the prior art that electric dampers are required to be mounted at the outlet of the air duct, not only saves the economical cost, but also greatly reduces the difficulty of assembly, and avoids the disadvantage of affecting the performance of the refrigerator 200 due to malfunctions.

The above are only preferred embodiments of the present application, and are not intended to limit the present application. Any modification, equivalent replacement and improvement made within the spirit and principle of the present application shall be within the protection scope of the present application.

What is claimed is:

1. A refrigerator, comprising:

a freezing chamber;

a refrigerating chamber;

an air draft and guide cavity provided on a back of the freezing chamber, the air draft and guide cavity including a funnel-shaped air collecting cavity, the funnel-shaped air collecting cavity including a first portion and a second portion, a conical air outlet cavity connected to the funnel-shaped air collecting cavity, a first inlet of the funnel-shaped air collecting cavity being in fluidic communication with the freezing chamber, the first inlet of the funnel-shaped air collecting cavity separates the first portion from the second portion of the funnel-shaped air collecting cavity, a first outlet of the funnel-shaped air collecting cavity being in fluidic communication with a second inlet of the conical air outlet cavity, the first outlet being further away from the first portion than the second portion of the funnel-shape air collecting cavity, and a second outlet of the conical air outlet cavity being in fluidic communication with the refrigerating chamber, the first outlet and the second inlet having a first width, the second outlet having a second width greater than the first width;

a division tongue provided in the conical air outlet cavity, the division tongue structured to create a first outlet duct and a second outlet duct within the conical air outlet cavity, the first outlet duct facing a left side wall of the funnel-shaped air collecting cavity, and the second outlet duct facing a right side wall of the funnel-shaped air collecting cavity, the first outlet duct and the second outlet duct being in fluid communication with the second outlet of the conical air outlet cavity; and a fan provided inside the first portion of the funnel-shaped air collecting cavity;

wherein when the fan rotates in a first rotation direction, cold air communicated from the freezing chamber is guided by the left side wall of the funnel-shaped air collecting cavity and conveyed through the first outlet duct into the refrigerating chamber, and when the fan rotates in a second rotation direction that is opposite to the first rotation direction, cold air communicated from the freezing chamber is guided by the right side wall of the funnel-shaped air collecting cavity and conveyed through the second outlet duct into the refrigerating chamber.

2. The refrigerator of claim 1, wherein a portion of the division tongue adjacent to the funnel-shaped air collecting cavity is configured with a first side wall and a second side wall, wherein the first side wall is parallel to the left side wall of the funnel-shaped air collecting cavity, and the second side wall is parallel to the right side wall of the funnel-shaped air collecting cavity.

3. The refrigerator of claim 1, wherein the division tongue is coupled to a front or a rear side wall of an upper portion of the conical air outlet cavity.

4. The refrigerator of claim 2, wherein the portion of the division tongue adjacent to the funnel-shaped air collecting cavity is configured as a structure in which a tip end faces upstream, and wherein when the fan rotates in the first direction, the first side wall is parallel to a right side wall of an upper portion of the conical air outlet cavity so as to form the first outlet duct as a primary outlet duct, and the second side wall is parallel to a left side wall of the upper portion of the conical air outlet cavity so as to form the second outlet duct as a secondary outlet duct.

5. The refrigerator of claim 2, wherein the portion of the division tongue adjacent to the funnel-shaped air collecting cavity is configured as a structure in which a tip end faces upstream, and wherein when the fan rotates in the second direction, the second side wall is parallel to a left side wall of an upper portion of the conical air outlet cavity so as to form the second outlet duct as a primary outlet duct, and the first side wall is parallel to a right side wall of the upper portion of the conical air outlet cavity so as to form the first outlet duct as a secondary outlet duct.

6. The refrigerator of claim 2, wherein a lateral width of a portion of the division tongue away from the funnel-shaped air collecting cavity successively decreases from top to bottom, wherein an outer surface of the portion of the division tongue away from the funnel-shaped air collecting cavity is configured as an arc-transition surface.

7. The refrigerator of claim 1, wherein the first outlet of the funnel-shaped air collecting cavity is connected to an inlet of the first outlet duct and an inlet of the second outlet duct, an outlet of the first outlet duct and an outlet of the second outlet duct are in fluidic communication with the outlet of the conical air outlet cavity.

* * * * *